US006435958B1

(12) United States Patent
Damgaard et al.

(10) Patent No.: US 6,435,958 B1
(45) Date of Patent: Aug. 20, 2002

(54) ABRASIVE MEANS AND A GRINDING PROCESS

(75) Inventors: Morten J. Damgaard, Store Merløse; Per Buus Øding, Fredensborg, both of (DK)

(73) Assignee: Struers A/S, Rødovre (DK)

( * ) Notice: Subject to any disclaimer, the term of this patent is extended or adjusted under 35 U.S.C. 154(b) by 0 days.

(21) Appl. No.: 09/485,730

(22) PCT Filed: Aug. 14, 1998

(86) PCT No.: PCT/DK98/00350

§ 371 (c)(1),
(2), (4) Date: Mar. 9, 2000

(87) PCT Pub. No.: WO99/08837

PCT Pub. Date: Feb. 25, 1999

(30) Foreign Application Priority Data

Aug. 15, 1997 (DK) ..... 0943/97

(51) Int. Cl.[7] ..... B24D 11/00

(52) U.S. Cl. ..... 451/526; 451/527; 451/530; 451/28

(58) Field of Search ..... 451/526, 59, 532, 451/539, 28, 527, 530; 51/293, 295, 307, 59, 308, 309

(56) References Cited

U.S. PATENT DOCUMENTS

| | | | | | |
|---|---|---|---|---|---|
| 5,213,589 | A | * | 5/1993 | Ronning et al. | 451/526 |
| 5,269,821 | A | * | 12/1993 | Helmin et al. | 51/295 |
| 5,667,842 | A | * | 9/1997 | Larson et al. | 51/295 |
| 5,727,993 | A | * | 3/1998 | Kodate | 451/526 |
| 5,792,544 | A | * | 8/1998 | Klein | 451/526 |
| 5,840,090 | A | * | 11/1998 | Ho et al. | 451/526 |
| 6,007,591 | A | * | 12/1999 | Watanabe | 51/309 |

* cited by examiner

*Primary Examiner*—Joseph J. Hail, III
*Assistant Examiner*—Lee Wilson
(74) *Attorney, Agent, or Firm*—Dykema Gossett PLLC

(57) ABSTRACT

An abrasive element for grinding samples during supply of liquid lubricant includes a layer of binding agent containing grains of a grinding agent and particles of an organic acid, the organic acid being soluble in the lubricant and the particles thereof having sizes of 5 to 250 $\mu$m.

14 Claims, 2 Drawing Sheets

ABRASIVE MEANS AND A GRINDING PROCESS

BACKGROUND OF THE INVENTION

1. Field of the Invention

Figure 1:
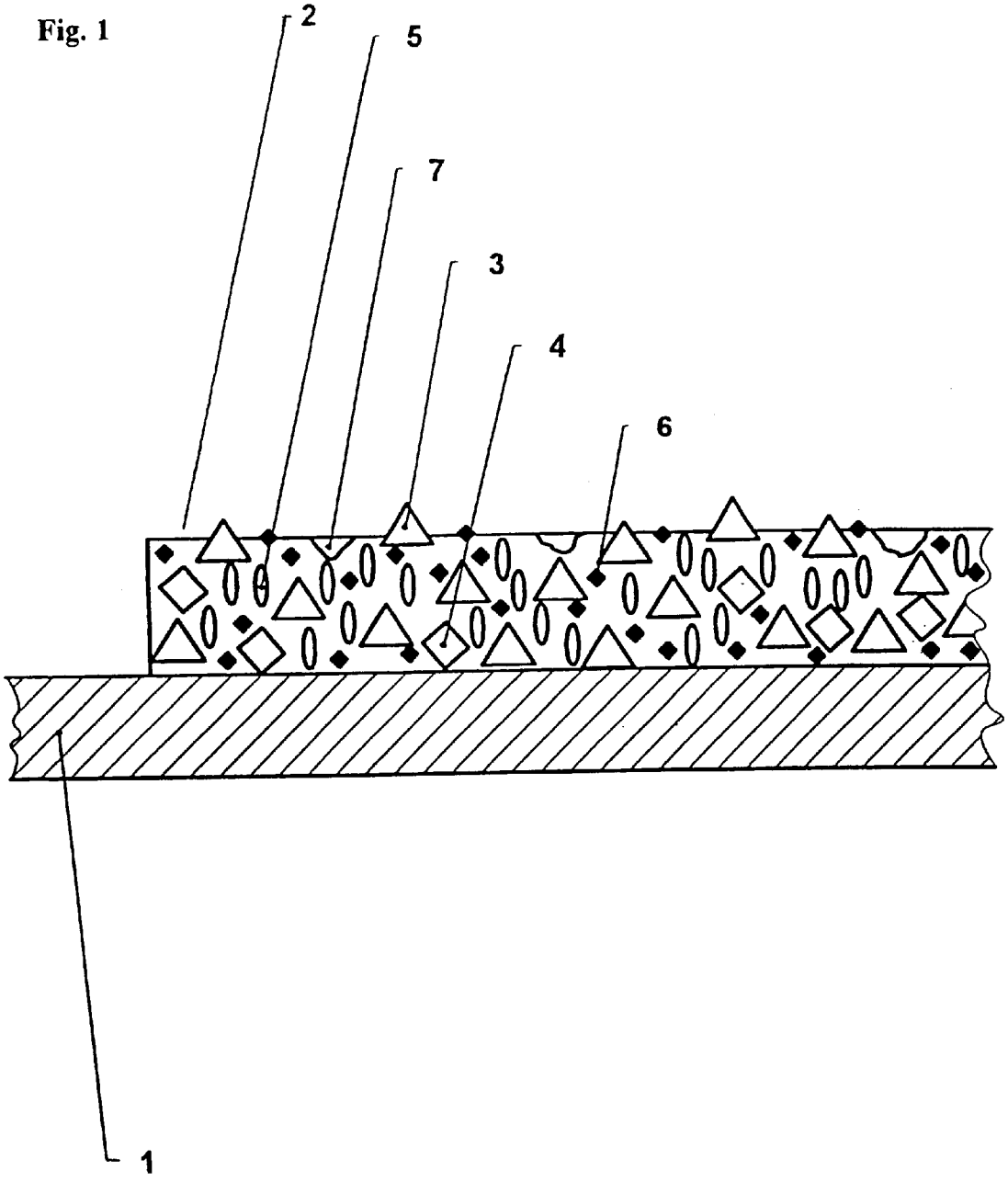

The present invention relates to an abrasive means for grinding samples during supply of a liquid lubricant and including a binding agent layer having grains of a grinding agent and a soluble material incorporated therein.

2. The Prior Art

In the art of materialography (the study of materials, e.g. metals) it is common practice to grind and/or polish the samples before performing the various analyses on them. For most analyses, it is crucial that the surface of the sample to be analyzed is as smooth and/or planar as possible.

The prior art abrasive means and in particular the abrasive means typically used for grinding materialographic samples, such as grinding paper, normally have the drawback that they initially produce a relatively strong removal of material, and that the removal of material is reduced significantly over time as the abrasive grains are worn down or loosened from the binding agent layer.

It has been attempted to obtain a more uniform removal of material over time by using a layer of binding agent which during the advancing of the grinding process is partly decomposed, thus exposing new grinding grains.

Accordingly, U.S. Pat. No. 3,925,034 discloses a process for the preparation of abrasive disks comprising an abrasive layer of grinding grains, a resin based binding agent and a voluminously substantial amount of porous resin beads, said beads creating cavities in the abrasive layer due to thermal melting, thus causing the worn down grinding grains to be loosened at a suitable rate during the grinding process.

U.S. Pat. No. 5,549,961 discloses grinding means comprising an abrasive layer consisting of a binding agent, grinding grains and a plasticizer, which facilitates the removal of worn down grinding grains and the exposure of new ones.

EP 0 486 308 discloses grinding means comprising a layer of a binding agent comprising incorporated grinding grains covered with a coating produced from a mixture of an epoxy resin, an emulsifier for the epoxy resin, a curing agent, a grinding aid dispersed in the epoxy resin and water. As examples of grinding aids are mentioned waxes, organic halogen containing compounds, halogen salts, metals and metal alloys.

In some grinding and/or polishing processes, it is common to supply a lubricant during the process. The purpose of supplying a lubricant during the grinding process is partly to reduce friction, partly to remove frictional heat which arises during the grinding and partly to remove the material which is removed from the treated sample and fragments of grinding grains. As lubricant water or mixtures of water with water miscible alcohols is typically used, and the lubricant is typically supplied continuously during the grinding process.

U.S. Pat. No. 5,476,416 discloses a flexible grinding stone comprising a flexible plastic material having mixed therewith a powder synthetic detergent and an abrasive such as silica sand and calcium carbonate composed of grains from 3 to 50 $\mu$m, and capable of simultaneously removing minute protrusions and stain from coated surfaces. The powder synthetic detergent is present in the form of particles having a particle size of 30 to 1500 $\mu$m, and it is mentioned that the detergent particles can dissolve in water optionally supplied during the grinding process thus exposing fine abrasive particles from within the grinding stone. According to U.S. Pat. No. 5,476,416 the detergent particles are most effective when applied in an amount of 10–20 weight-% and having a particle size from 100 to 1500 $\mu$m.

Flexible grinding stones are unfortunately not expedient for all grinding purposes. Particularly when the objective is to obtain an extremely planar or smooth surface, e.g. in connection with material analysis or precision grinding, it is preferable that the resilience of the grinding means is relatively low. If the grinding means is too flexible it will also potentially be worn down unevenly eventually leading to an uneven treatment of the sample to be ground, which in most cases is highly unacceptable.

Furthermore, the use of a detergent in a grinding process is generally undesirable because it can dissolve in certain binding agents, thus losing the effect and even possibly impair the binding agent properties. In addition, particles consisting of a detergent can be too soft and/or brittle thus being compressed too easily during the grinding process.

Accordingly there persists a need for an abrasive means capable of providing an even abrasion over time as well as over the entire grinding surface of the means and without having the above mentioned deficiencies.

SUMMARY OF THE INVENTION

This objective is obtained by the abrasive means according to the invention, wherein the binding agent layer includes discrete particles incorporated therein including one or more organic acids soluble in the lubricant and having a particle size from 5 to 250 $\mu$m.

The invention is based on the acknowledgement that particles and particularly crystals consisting essentially of organic and especially weak acids are surprisingly suitable for use as erosion controlling soluble particles incorporated in the commonly applied binding agents in abrasive means particularly for use in the art of materialography, and which are used in connection with water or aqueous media as lubricant.

The discrete particles preferably comprise at least 50 weight-%, more preferably at least 75 weight-% and even more preferably substantially consist of organic acids.

One particular advantage of using crystals essentially of organic acids in the grinding means according to the invention is that the crystals within the binding agent matrix exhibit a very low compressibility, and consequently, it is now possible to obtain an even abrasion over time as well as over the entire grinding surface of the means.

Particles of such organic acids furthermore distinguish themselves by being easy to distribute within the normally applied binding agents. Even further, the organic acids prevent the formation of iron oxides, which reduces the formation of red rust sediments when grinding iron containing materials.

Due to citric acid's high solubility, low reactivity, good accessibility and relatively low price, particles of citric acid are particularly preferred for use in the abrasive means according to the invention.

Other preferred organic acids comprise P-hydroxy benzoic acid, glycolic acid, lactic acid, hydracrylic acid, oxalic acid, amygdalic acid, tartaric acid, salicylic acid, maleic acid, malic acid and malonic acid. The acids according to the invention are preferably hydroxy carboxylic acids and/or they have preferably a number of carbon atoms ranging from about 2 to 12.

The acids, their salts and/or esters can be used alone or in any combination.

According to the invention, the preferably aqueous lubricant is used for specifically fulfilling the function to remove parts of the abrasive layer in such a way that there is a continuous opening of the surface of the abrasive layer and thus an exposure of new grinding grains which have been incorporated into the binding agent layer.

By the addition of the liquid lubricant, a solution of the discrete soluble organic acid particles being situated in the surface zone of the layer of binding agent will occur, by which small cavities are formed in the surface of said layer. These cavities facilitate the decomposition of top layer of the layer of binding agent by weakening the layer, when the grinding grains situated in the surface are partly or completely worn out. In this way, new grinding grains and soluble particles are exposed and the above described process can repeat itself continuously.

Accordingly, by using a binding agent layer having incorporated discrete particles instead of porous resin beads, it is also an advantage in that the formation of the desired cavities can happen without heating and that the resistivity against the pressure which the sample to be ground urges against the abrasive layer during the grinding is not affected adversely.

By adjusting the amount of particles with the particle size, a desired erosion speed can be obtained and thus a uniform and controlled removal of material during the grinding process.

The average particle size of the applied organic acids is preferably in the range from 5 to 250 $\mu$m, more preferably 5 to 70 $\mu$m.

The amount of incorporated discrete particles can, depending on the sample to be ground, the grinding grains and the particle size of the soluble particles, be varied within a wide range but constitute preferably between 5 and 30 volume-% (approximately around 8 to 48 weight-%) and particularly between 10 and 20 volume-% (approximately around 16 to 32 weight-%).

The discrete particles must be soluble in the lubricant. The term soluble as used in connection with the discrete particles shall be understood in such a way that if the lubricant is water the solubility at 20° C. shall be at least 30% w/w and preferably at least 59.2% w/w.

As grinding grains diamond, silicon carbide and aluminium oxide is preferably used or grains of other materials having great hardness. The grinding grains can be comprised by one or more materials.

As binding agent an epoxy resin is preferably used, but other known binding agent types such as melamine resins, phenol resins, acrylic resins and polyester resins can be used. It is generally preferred that the layer of binding agent has a relatively low resilience and the hardness of the layer is preferably around 50 to 90 Shore D more preferably around 60 to 85 Shore D. It has proven particularly advantageous to use a PACM-curing agent or a similar curing agent capable of rising the glass transition temperature of the cured epoxy resin. By rising the glass transition temperature of the resin, the benefits according to the invention can be expressed in a wider temperature range, i.e. at elevated temperatures, which is important due to the frictional heat caused by the relative movement of the abrasive means on the sample.

The layer of binding agent is preferably applied to a base layer, which in a more or less known manner can be constituted by a woven or non-woven textile, paper, plastic or metal, and base layers of metal foils are particularly preferred.

The abrasive means according to the invention can basically have the shape of any known abrasive means. However, it is generally preferred that the means has the shape of an abrasive disk. The abrasive disk according to the invention has preferably a standard size for fitting the abutment of a grinding apparatus. Such an abutment in a grinding apparatus for use in the art of materialography has typically a diameter of around 200, 250, 300, 350 or 400 mm.

In order to facilitate the temporary fixation of the abrasive means according to the invention to a magnetized movable abutment in a grinding apparatus, it is preferred that the base layer comprises ferromagnetic material. The ferromagnetic material according to this embodiment can be in any form and be placed anywhere in the abrasive means and particularly in the base layer, e.g. in terms of ferromagnetic granules incorporated in a polymer liner. However, according to the invention, it is strongly preferred to use a metal foil as base layer.

Besides possessing higher mechanical strength than a plastic base layer containing particles of a ferromagnetic substance, a foil of a ferromagnetic substance, such as an iron foil, has smaller resilience and a better heat conductivity, so that the frictional heat which is generated during the abrasion or polishing can be discharged via the abutment.

It is thus preferred to use a ferromagnetic foil having a thickness of around 0.05–1 mm as base layer according to the invention, as thinner foils do not have the desired strength, and foils having a larger thickness than 1 mm are so rigid that they impede removal from and mounting on the abutment. The thickness of the foil is preferably around 0.1 to 0.7 mm and more preferably around 0.25 to 0.35 mm, and it has turned out to be particularly expedient to use iron foils having a thickness of around 0.3 mm.

In order to avoid corrosion of the iron foil, it is preferred to coat the foil with a base lacquer and/or plate it with a thin layer of another metal or alloy, e.g. nickel, chromium and/or preferably tin.

The base layer of the abrasive means according to the invention may also or as an alternative to the ferromagnetic properties discussed above be provided with a layer of an adhesive material on the side to be facing the abutment during use in order to provide the necessary temporary fixation to said abutment.

Besides grinding grains and soluble particles, the layer of binding agent can comprise more or less per se known additives and/or grinding aids such as graphite or silicon carbide.

Other admissible and/or preferred additives comprise wax, polytetrafluoroehtylene (teflon®), cryolite, calcium carbonate or combinations thereof.

It is an advantage to use the soluble particles according to the invention together with one or more grinding aids, because the abrasive means' grinding and decomposition characteristics thus can easily be tailored the specific objective. Silicon carbide distinguishes itself by being particularly suitable for enhancing the wearability of the abrasive disk according to the invention.

The abrasive means according to the invention can be produced by applying a layer of liquid uncured binding agent comprising dispersed grinding grains and soluble particles and optional additives and aids to a basis layer, e.g. a metal foil, and by bringing the binding agent to cure. The binding agent mixture is preferably applied to the base layer by means of silk printing or similar processes.

The curing of the binding agent can e.g. be initiated by means of a curing agent added to the mixture, either by room temperature or by heating the coated metal foil.

The invention furthermore relates to a process for grinding samples during supply of a liquid lubricant and by means of an abrasive means comprising a binding agent layer having grains of a grinding agent and a soluble material incorporated therein, characterized in that the binding agent layer comprises discrete particles incorporated therein comprising one or more organic acids soluble in the lubricant and having a particle size from 5 to 250 μm, preferably 5 to 70 μm.

The invention will in the following be disclosed with reference to the illustrations, where FIG. 1 shows a schematic sectional view of a partly used abrasive disk according to the invention, and where FIG. 2 in a planar view shows the grinding surface of a preferred embodiment of a grinding disk according to the invention.

In FIG. 1, 1 designates a metal foil, e.g. a tinned steel foil having a thickness of about 300 μm, and 2 designates a coating in terms of a layer of binding agent. In the binding agent layer 2, there is incorporated abrasive grains 3, such as diamond grains having a particle size of 1 to 250 μm, water soluble particles, such as citric acid crystals having a particle size of 5 to 70 μm, particles 5 of a grinding aid, such as graphite, having a particles size of around 4 μm and particles 6 of a grinding aid, such as silicon carbide, having a particle size of 1 to 70 μm.

As it appears in FIG. 1, there has been created cavities 7 in the surface of the binding agent layer 2, which cavities are caused by the solubilization of soluble particles 4, which have been situated in the surface zone and have been affected by an aqueous lubricant, which has been supplied during the grinding process.

Figure 2:
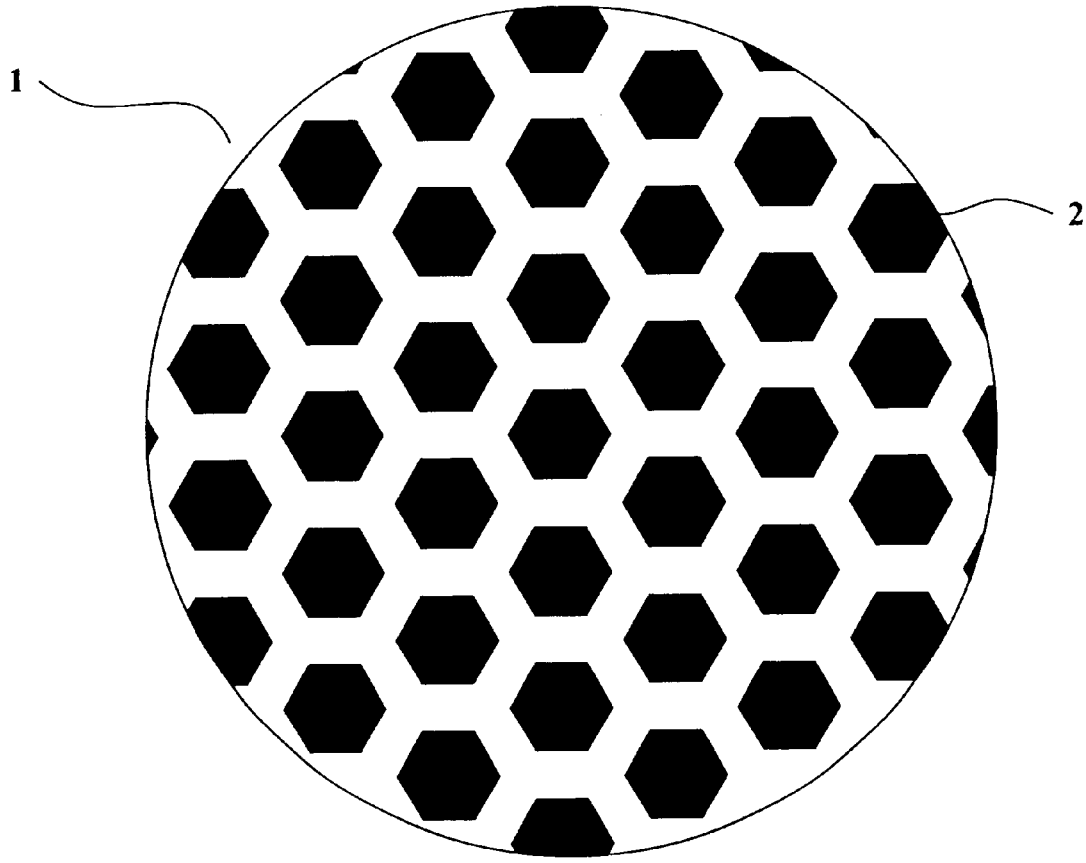

In FIG. 2, a grinding disk 1 is shown in a preferred embodiment, where coatings 2 of a binding agent having incorporated grinding grains and particles of a soluble material are shaped as discrete hexagonal segments.

What is claimed is:

1. An abrasive means for grinding samples during supply of a liquid lubricant and comprising a binding agent layer having grains of a grinding agent and a solid material which is soluble in an aqueous liquid incorporated therein, wherein said binding agent layer comprises discrete particles incorporated therein comprising at least one organic acid having a particle size from 5 to 250 μm, said abrasive means being obtainable by applying a layer of liquid uncured binding agent comprising said particles and dispersed grinding grains to a basis layer, and curing said binding agent.

2. An abrasive means according to claim 1, wherein the particle size is from 5 to 70 μm.

3. An abrasive means according to claim 1, wherein the particles are in the form of crystals.

4. An abrasive according to claim 1, wherein the particles are selected from at least one organic acid having a solubility of at least 30% w/w in water having a temperature of 20° C.

5. An abrasive means according to claim 1, wherein the particles consist substantially of citric acid.

6. An abrasive means according to claim 1, wherein the discrete particles constitute 5 to 30 volume-% of the binding agent layer.

7. An abrasive means according to claim 1, wherein the discrete particles constitute 10 to 20 volume-% of the binding agent layer.

8. An abrasive means according to claim 1, wherein the binding agent layer is a layer of epoxy resin.

9. An abrasive means according to claim 1, wherein the grinding grains are selected from the group consisting of diamond grains, silicon carbide grains and aluminum oxide grains.

10. An abrasive means according to claim 1, including at least one grinding aid such as SiC and/or graphite.

11. An abrasive means according to claim 10, wherein the basis layer is selected from the group consisting of textile, paper, plastic and metal.

12. An abrasive means according to claim 11, wherein the basis layer comprises a metal foil.

13. A process for grinding samples during supply of a liquid lubricant and by means of an abrasive means comprising a binding agent layer having grains of a grinding agent and a soluble material incorporated therein, wherein the binding agent layer comprises discrete particles incorporated therein comprising at least one organic acid soluble in the lubricant and having a particle size from 5 to 250 μm.

14. An abrasive means according to claim 4, wherein said organic acid has a solubility of at least 59.2% w/w.

* * * * *